US007111486B2

(12) United States Patent
Figge

(10) Patent No.: US 7,111,486 B2
(45) Date of Patent: Sep. 26, 2006

(54) ROLL STAND FOR HOT-ROLLING OR COLD-ROLLING METALLIC STRIPS

(75) Inventor: Dieter Figge, Essen (DE)

(73) Assignee: SMS Demag AG, Düsseldorf (DE)

( * ) Notice: Subject to any disclaimer, the term of this patent is extended or adjusted under 35 U.S.C. 154(b) by 341 days.

(21) Appl. No.: 10/433,758

(22) PCT Filed: Dec. 1, 2001

(86) PCT No.: PCT/EP01/14066

§ 371 (c)(1),
(2), (4) Date: Jun. 5, 2003

(87) PCT Pub. No.: WO02/47836

PCT Pub. Date: Jun. 20, 2002

(65) Prior Publication Data

US 2004/0040359 A1 Mar. 4, 2004

(30) Foreign Application Priority Data

Dec. 14, 2000 (DE) ..... 100 62 489

(51) Int. Cl.
*B21B 31/07* (2006.01)

(52) U.S. Cl. ..... 72/245; 72/241.8; 72/248

(58) Field of Classification Search ..... 72/241.2, 72/241.6, 241.8, 248, 245

See application file for complete search history.

(56) References Cited

U.S. PATENT DOCUMENTS 1,887,870 A * 11/1932 Coe ..... 72/241.2
3,302,435 A 2/1967 Lyle et al.
4,218,905 A * 8/1980 Lehmann et al. ..... 72/14.5
4,402,207 A * 9/1983 Buder ..... 72/241.2

(Continued)

FOREIGN PATENT DOCUMENTS

EP 1036605 9/2000

OTHER PUBLICATIONS

Patent Abstracts of Japan, vol. 016, No. 119 (M-1225), Mar. 25, 1992 & JP 03 285708 A (Ishikawajima Harima Heavy Ind Co Ltd), Dec. 16, 1991.

(Continued)

*Primary Examiner*—Dmitry Suhol
(74) *Attorney, Agent, or Firm*—Friedrich Kueffner

(57) ABSTRACT

The invention relates to a roll stand for hot-rolling or cold-rolling metallic strips. The roll stand comprises back-up rolls and work rolls (2, 3; 4, 5) which are respectively positioned in chocks (6; 7) in a rotating manner. Each chock (6; 7) can be displaced on two sides in guiding devices (8) of the column frame (9) for adjusting the roll gap (10) and can be additionally displaced on at least one side for adjusting the play, by means of horizontal piston cylinder units (11) arranged in the column frame (9). The aim of the invention is to completely eliminate the play in the vertical guiding device (8) of the work roll chocks (6; 7) during the rolling. To this end, the chocks which are guided on at least one side of the column (9*a*) by means of the piston cylinder unit (11) arranged in the column frame (9) and by means of one respective support element (14) which is arranged on the front side of the piston (11*a*), can be pressed against the other side of the column (9*b*) and the guiding device (8) thereof without play when the vertical roll positioning drive is stopped. and can be released when the vertical roll positioning device is switched on.

11 Claims, 8 Drawing Sheets

U.S. PATENT DOCUMENTS

| | | | | |
|---|---|---|---|---|
| 4,530,227 | A * | 7/1985 | Schlatter et al. | 72/241.6 |
| 4,747,291 | A * | 5/1988 | Kostopolos | 72/238 |
| 4,898,014 | A * | 2/1990 | Ginzburg et al. | 72/247 |
| 6,354,128 | B1 * | 3/2002 | Donini et al. | 72/237 |
| 6,510,721 | B1 * | 1/2003 | Yamamoto et al. | 72/245 |

OTHER PUBLICATIONS

Patent Abstracts of Japan, vol. 011, No. 014 (M-553), Jan. 14, 1987 & JP 61 189809 A (Ishikawajima Harima Heavy Ind Co Ltd), Aug. 23, 1986.

* cited by examiner

ROLL STAND FOR HOT-ROLLING OR COLD-ROLLING METALLIC STRIPS

The invention concerns a rolling stand for hot rolling or cold rolling of metallic strip material, e.g., of different grades of steel, with backup rolls and work rolls, each of which is pivoted in chocks. Each chock can be displaced on two sides in guiding devices of the column frame for adjusting the roll gap and can be additionally displaced on at least one side for adjusting the play by means of horizontal piston-cylinder units arranged in the column frames.

The work rolls of strip trains are exchanged for new work rolls every 4–6 hours due to wear. The procedure of work roll changing is presently carried out in an automatic cycle by means of a changing device. A gap of a few millimeters is provided between the column and chock to allow free play of the chocks during the vertical displacement for roll gap control.

In the hot rolling of individual slabs in a hot strip rolling mill, large impacts with enormous accelerations occur during the initial pass operation. The chocks are thrown against the column guide, which is greatly stressed. The impact load wears the guideway very quickly, the guide play increases, and the acceleration forces become greater and greater. Attempts have already been made to reduce these problems with hardened guide rails and a soft, yielding steel.

In cold rolling, an effort is made to position the work rolls a few millimeters (about 4 to 10 mm) in front of the center of the rolling stand, as seen from the rolling direction, for stabilization. A design that would be especially favorable would be one in which the mismatch in size could be adjusted, in order to support the profile control. However, the adjustment of the wedge strips at the beginning of the rolling operation is also disadvantageous, even if the adjustment is repeated at intervals of time, because, in light of the demand for displaceability of the work rolls, the play cannot be completely eliminated. On the other hand, this play is necessary, because, during the hot rolling operation, the chock heats and expands, but the rolling stand remains cold. To be sure, this reduces the play. However, this reduction in the play after heating can then again lead to jamming of the vertical displacement.

In all cases, an inexactly defined position of the work roll chocks in the stand is disadvantageous both in cold rolling and hot rolling. In addition, there is the requirement that the chocks must be vertically movable in the column guide. In this regard, it must be considered that modern rolling mills operate with so-called automatic gage control (AGC). On the basis of this AGC, a measurement is made shortly after the initial pass to determine whether the roll gap is of the desired size. In case of deviations, a readjustment is made by means of the hydraulic adjustment equipment in the stand under rolling force. In general, AGC ensures that the metal strip (steel strip) is always rolled With exactly the same thickness, independently of fluctuations in temperature and variations in deforming force. For rolling with a constant profile of the metal strip, a guide gap between the chock and the stand column is very unfavorable, because, due to the random position of the work rolls in the stand, an undesired offset of the work rolls among themselves can occur, which distorts the desired profile.

DE 44 34 797 A1 describes equipment for position correction of the bearing chocks of the rolls guided in the column windows of rolling stands. This equipment consists of hydraulically operated cylinder push rods, which are supported in cylinder recesses, which are supported in the bearing chocks. The cylinder push rods can be moved against one or both of the guide surfaces of the column windows of the rolling stand. In this way, the guide play of the chocks can be adapted to the particular course of the rolling process, but it cannot be completely eliminated. In addition, the detachment and reconnection of the hydrualic connection during roll changes is time-consuming and involves considerable expense; the changing program consists of about 80 rolls per finishing train.

Equipment for controllably influencing the frictional forces between the guide surfaces and bearing surfaces of the bearing chocks of the rolls supported in the column windows of rolling stands is also known (DE 199 11 638 A1), in which flat, bearing support plates, which can be acted upon by pressure from behind are installed as guide surfaces, which are movably supported in these perpendicular to the guide surfaces or support surfaces. However, very large guide surfaces are created in this way, and residual play also cannot be eliminated in this way.

The object of the invention is to eliminate completely the play of the work roll chocks in their vertical guide during rolling and in this way to dispense with a hydraulic connection to the chocks.

In accordance with the invention, this object is achieved in such a way that the work roll chocks, which are guided on at least one side of the column by means of the piston-cylinder unit arranged in the column frame and by means of one respective support element, which is arranged on the front end of the piston, can be pressed against the other side of the column and its guiding device without play, when the vertical roll positioning drive is stopped, and can be released, when the vertical roll positioning drive is turned on. In this way, the play of the chocks in the guide devices of the column windows is completely eliminated during rolling, as a result of which the results of the control by the AGC method are supported, and the rolling profile is more exactly maintained.

A refinement of the invention provides that each support element consists of a round with plastic guide strips embedded in it along its periphery, and that the round is supported in the column frame. In this design, the round absorbs transverse forces that act on the column frame and ensures a rigid construction of the play elimination during the rolling. During the changing of work rolls, the round can be moved back.

Another refinement provides that the round is fastened to the piston rod of the piston-cylinder unit. In this way, the round carries out all of the movements of the piston rod.

In addition, delicate movement of the piston can be achieved if the piston of the piston-cylinder unit can be acted upon by pressure on both sides.

The feeding of pressure medium is designed in such a way that the piston-cylinder unit can be supplied with pressure medium through channels in the column frame. Thus, during a roll change, it is not necessary to disconnect and reconnect hose lines.

In regard to the supplying of pressure medium, it is also advantageous for the channels for the pressure medium to open into grooves that run around the cylinder of the piston-cylinder unit.

Furthermore, in a design that is advantageous for the movements of the round, the round is made of red brass, and the guide strips embedded in the periphery of the round are made of Teflon.

The course of the play elimination and the allowance of motion play during adjustment of the roll gap, i.e., during the vertical displacement of the chocks, can be advantageously influenced, if the hydraulic pressure in the piston-cylinder unit can be regulated to different pressures for play adjustment or play elimination for the chock in the guiding device of the given side of the column, and if, for a vertical displacement of the chocks, the control can be switched to signals from an automatic gage control (AGC). In this way, the round can be pressed axially with full hydraulic pressure against the chock during the initial pass, and any play can be eliminated in this way. During operation under AGC, the hydraulic pressure is slightly reduced, so that vertical displacement of the chocks with the work rolls is made possible. Therefore, a control which in turn receives the signals of the AGC is advantageous. The control for the round recognizes the time at which the AGC requires a vertical displacement of the chock and can reduce the hydraulic pressure in the horizontal piston-cylinder unit in a suitably short time.

In accordance with additional features, a standard member for profile control by work roll bending can also be used in a completely unhindered manner. To this end, it is proposed that, in connection with a bending cylinder that acts on a roll neck and runs perpendicularly to the roll axis, several individual piston-cylinder units, which are arranged at some distance from the bending cylinder, act on a piston head, which is provided with the round. In this regard, it is possible to use, for example, a May West bending block. A CVC control by axial displacement of profiled rolls can likewise be used.

When bending devices of this type are used, it may be advantageous if the piston-cylinder units for the round are arranged symmetrically to the axis of the bending cylinder in polygonal corners. This arrangement utilizes the available space and the, available surface areas around the bending cylinder.

Furthermore, it may be advantageous, for reasons of area or space, if the central longitudinal axis of the round is arranged eccentrically with respect to the axis of the work roll.

In another variation of the arrangement of several smaller piston-cylinder units, two or more rounds, each with a smaller circular area, are provided on the theoretically provided circular area of the round. Measures of this sort may offer design advantages in individual cases.

In the case that considerable frictional resistance arises, e.g., static friction, during the change from pressing to release of the round, the invention may also be designed in such a way that the support element consists of a sliding shoe, which is shaped similarly to a sled runner with suitable runner width and engages with the guiding device of the chocks.

The drawings illustrate embodiments of the invention, which are explained in greater detail below.

Figure 1:
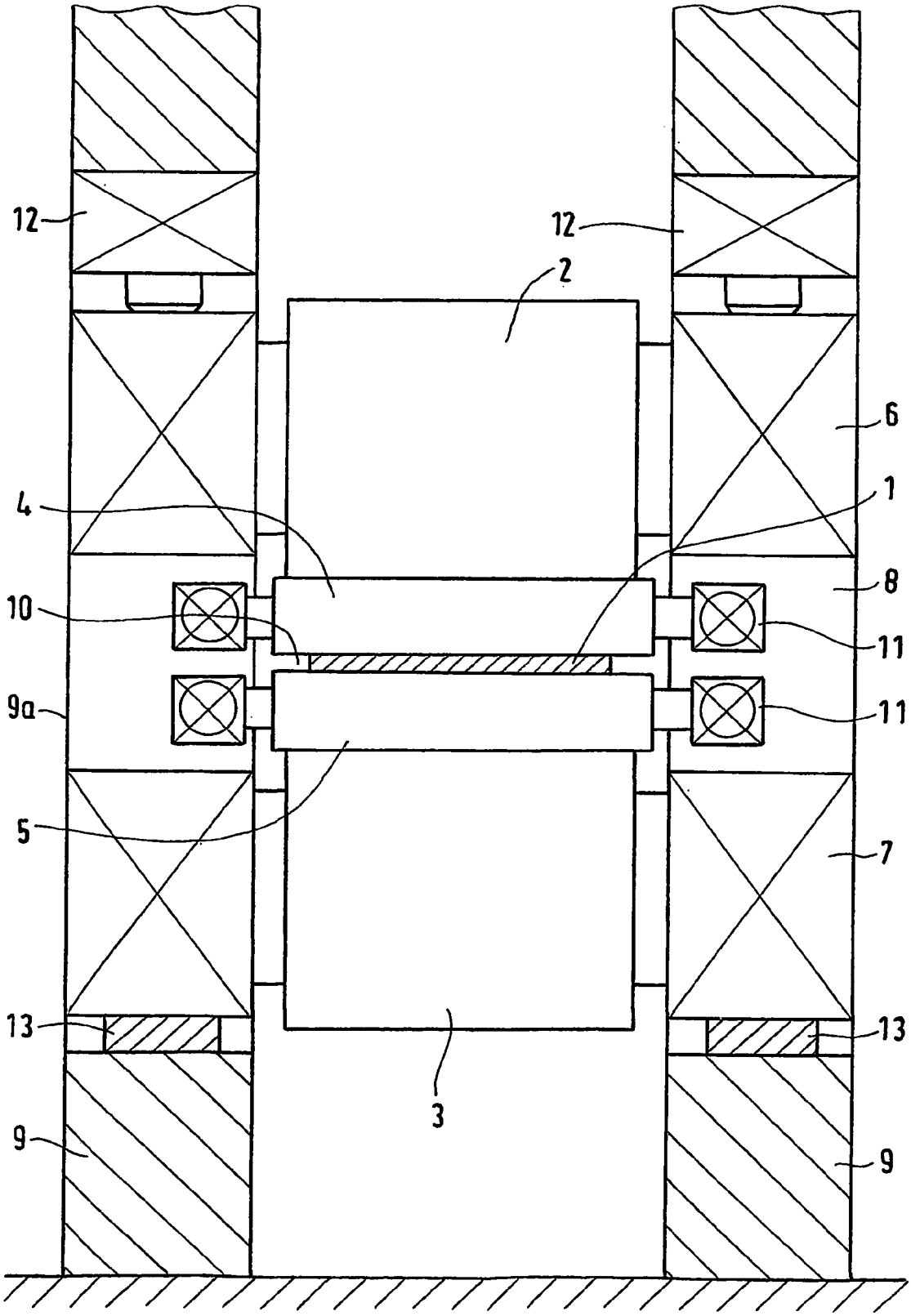
FIG. 1 shows a vertical section through a four-high rolling stand in a front view.
Figure 2:
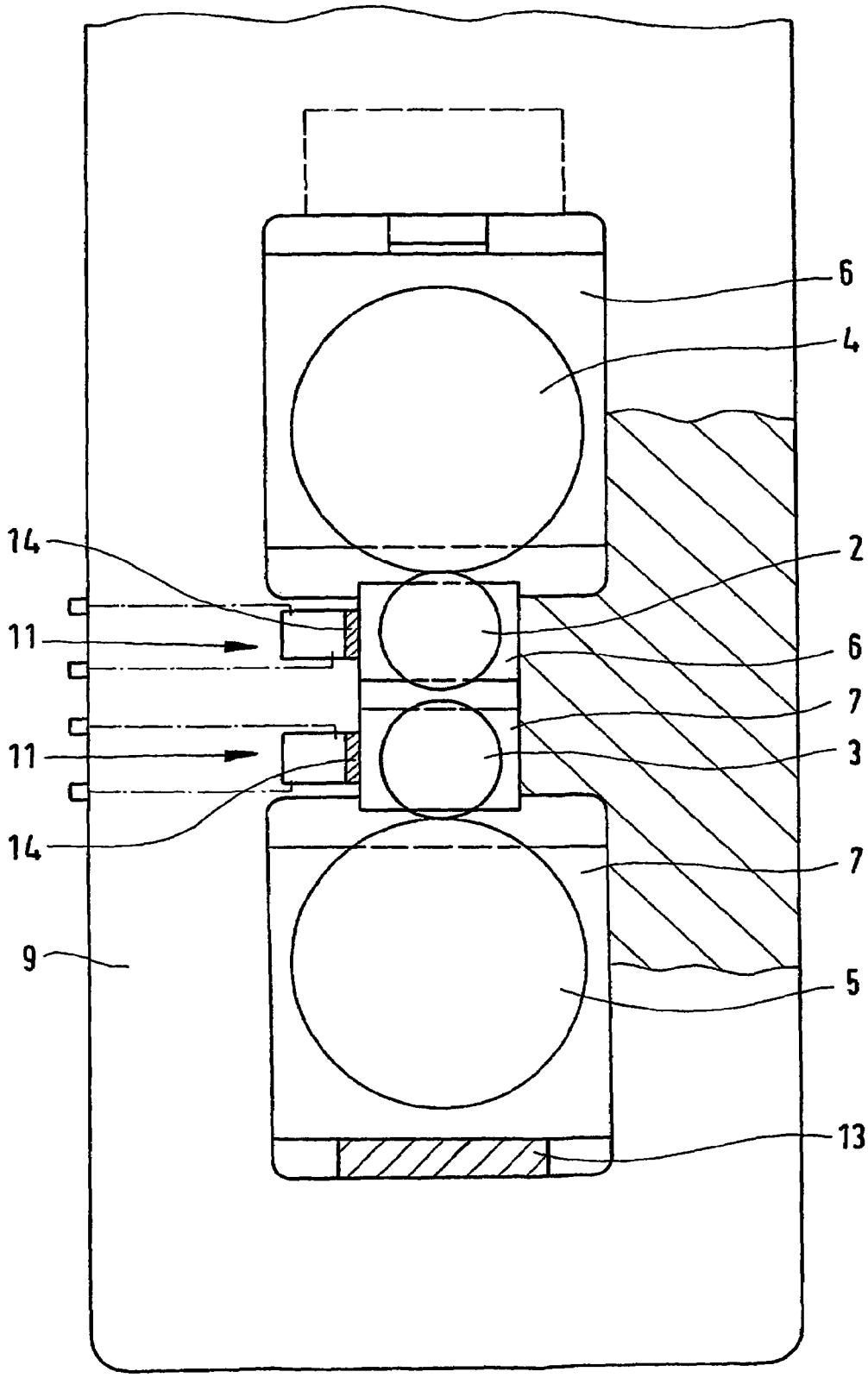
FIG. 2 shows a corresponding side view with a partial section through the four-high rolling stand.

The rolling stand in FIG. 1, a four-high rolling stand, is used for the hot rolling or cold rolling of metallic strip material 1, which consists, e.g., of various grades of steel, and has backup rolls 2, 3 and work rolls 4, 5, each of which is pivoted in chocks 6, 7. The chocks 6, 7 for the backup rolls 2, 3 or for the work rolls 4, 5 are slidably supported on both sides in guiding devices 8 of a column frame 9 for adjusting the roll gap 10. In addition, horizontal piston-cylinder units 11 are provided on at least one side in the column frame 9 (cf. FIG. 2) for play adjustment of the chocks 6, 7 for the work rolls 4, 5.

The upper backup roll 2 is equipped with hydraulic operating cylinders 12, which operate according to an AGC. The lower chocks 7 rest on load cells 13 in the column frame 9. The work roll chocks 6, 7 for at least one column side 9*a* are guided in all directions by means of the horizontal piston-cylinder units 11 arranged in the column frame 9 and by means of a support element 14 arranged on the front end of the piston 11*a* of each chock, pressed against the other side of the column 9*b* and its guiding device without play, when the vertical roll positioning drive, which consists of the hydraulic vertical operating cylinders 12, is stopped, and slightly released, when the vertical roll positioning drive is turned on, so that a sliding displacement of the chocks 6, 7 can take place.

Figure 3:
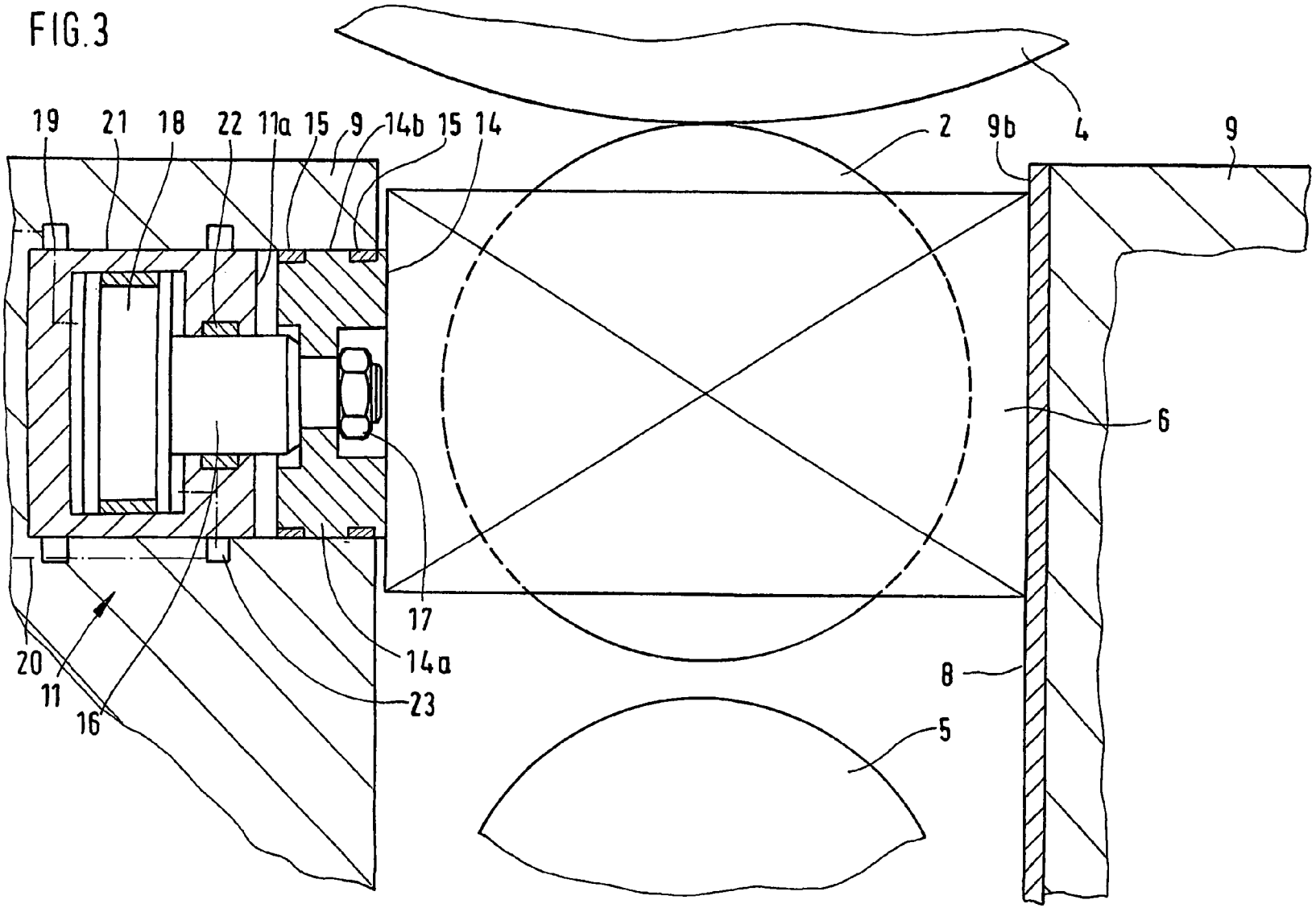
FIG. 3 shows an enlarged section through the round with a horizontal piston-cylinder unit.

Each of the support elements 14 consists of a cylindrical body, which is referred to as a round for short (FIG. 3), such that the round 14*a* is produced from metal, e.g., red brass, and, on the periphery 14*b*, guide strips 15 made of plastic, e.g., Teflon, are embedded.

Figure 4:
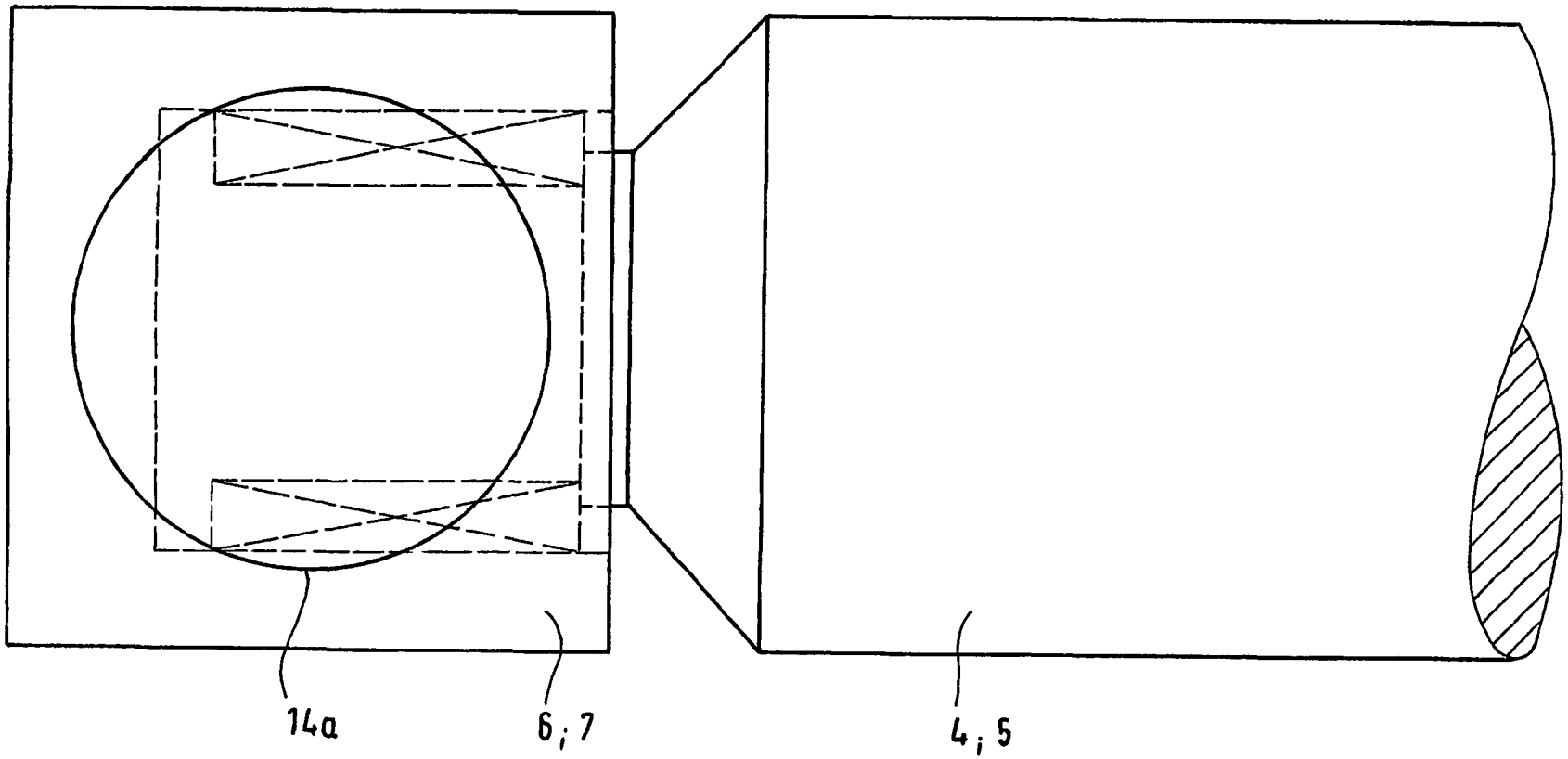
FIG. 4 shows a side view towards the round.

The round 14*a* is fastened to a piston rod 16 of the horizontal piston-cylinder unit 11 by a screw connection 17. As the drawing shows, the piston 18 of the horizontal piston-cylinder unit 11 can be acted upon by pressure medium on both sides. The pressure medium for the piston-cylinder unit 11 is fed to the two sides of the piston through channels 19 and 20. The channels 19 and 20 run inside the column frame 9. The channels 19, 20 open into grooves 22, 23, respectively, that run around the cylinder 21 and the piston rod 16, respectively. FIG. 4 shows the circular outer shape of the round 14*a*.

In accordance with an alternative embodiment, the control of the hydraulic pressure in the piston-cylinder unit 11 is adjusted and can be suitably regulated to the different pressures for play adjustment, when the vertical roll positioning drive is actuated, or play elimination for the chock 6 or 7 by actuation of the horizontal piston-cylinder unit 11 in the guiding device 8 and the given column side 9*a* or 9*b*, for which, in a vertical displacement of the chocks 6 or 7 with the backup rolls 2 or 3, the control is switched to signals from an automatic gage control.

Figure 5:
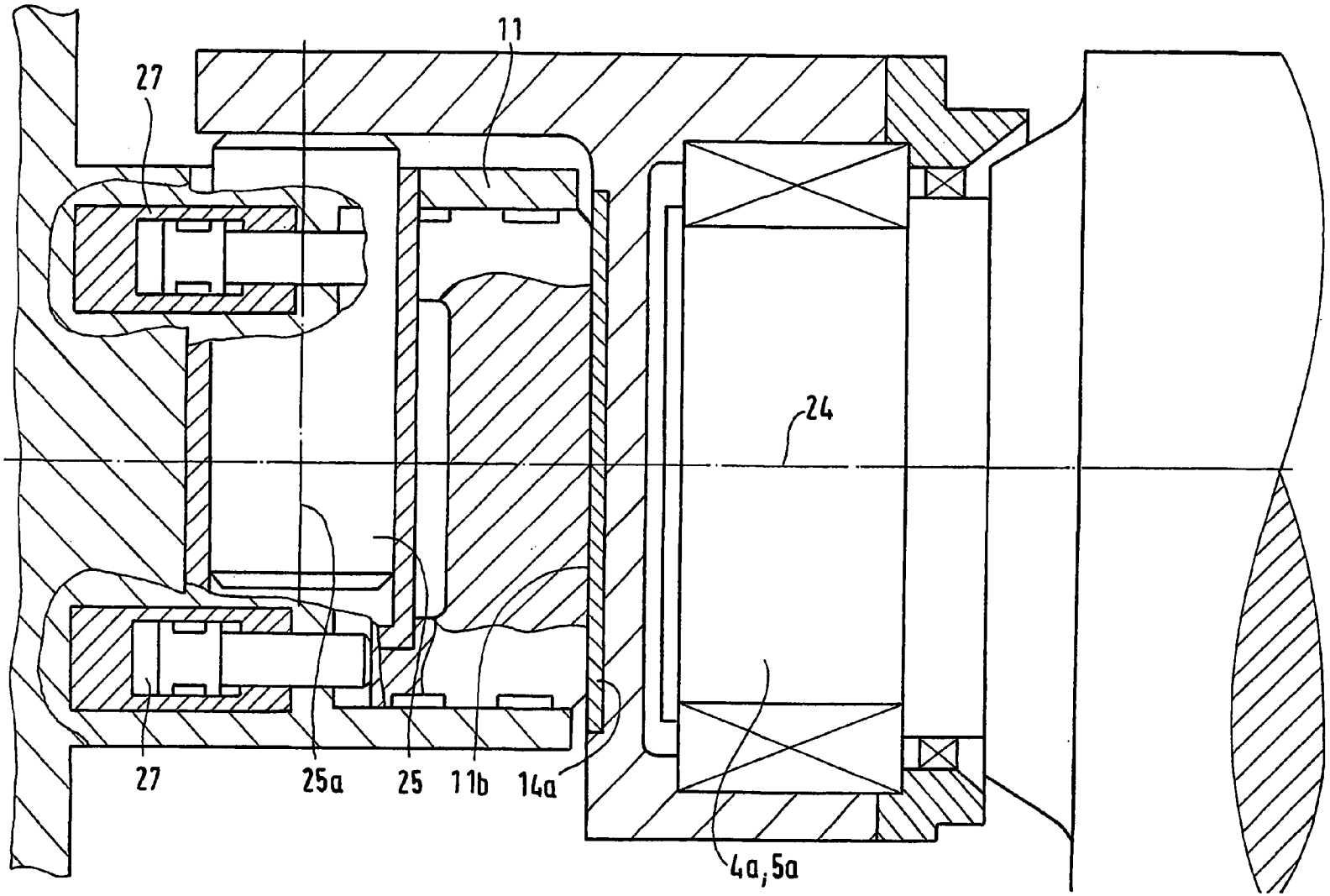
FIG. 5 shows an embodiment with a bending block on a roll neck and several piston-cylinder units for eliminating the play.
Figure 6:
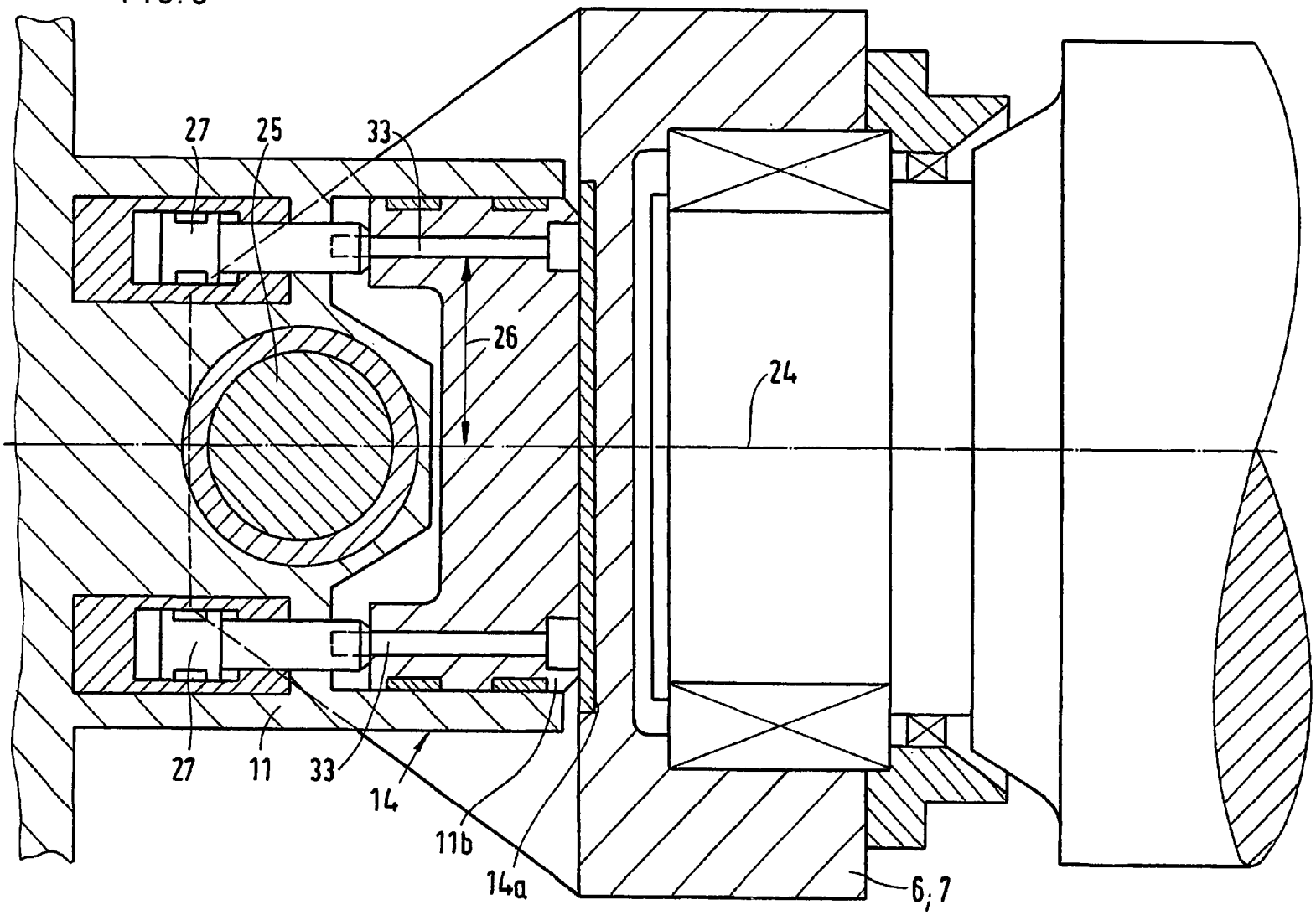
FIG. 6 shows a horizontal section through an embodiment with a bending cylinder and several smaller piston-cylinder units for eliminating the play of the chocks.

Another embodiment (FIG. 5) provides for a connection with a bending cylinder 25 that acts on a roll neck 4*a* or 5*a* and runs perpendicularly to the roll axis 24. In this embodiment, the round 14*a* of the support element 14 is formed in the piston-cylinder unit 11, which consists of several smaller piston-cylinder units 27, which are arranged at a distance 26 (cf. FIG. 6) from the bending cylinder 25. The piston head 11*b* is provided with the round 14*a*. The relatively large piston head 11*b* and the relatively small piston-cylinder units 27 are suitably joined by hexagonal socket screws 33 in order also to be able to withdraw the given piston head.

Figure 7:
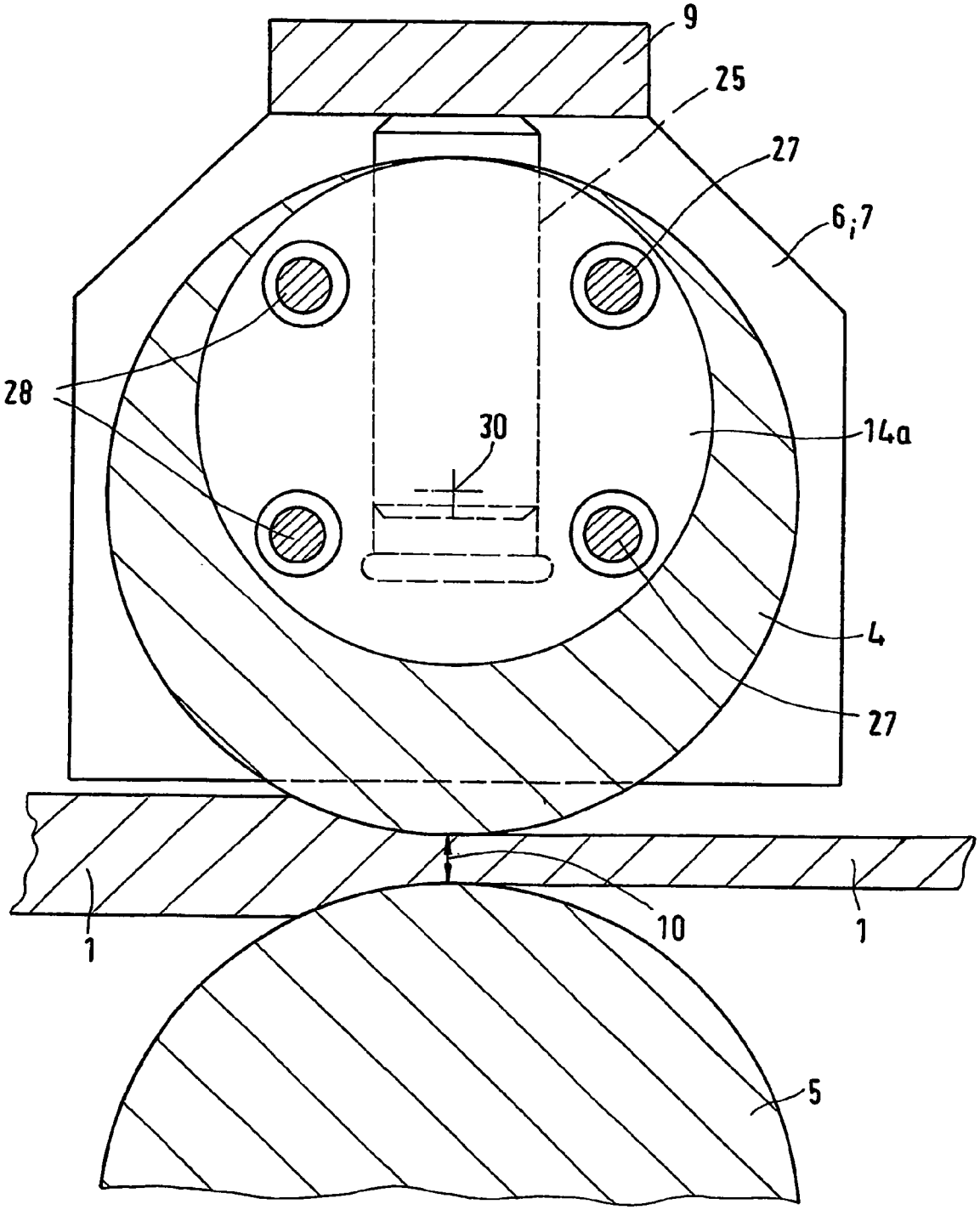
FIG. 7 shows a side view towards the round in FIG. 6.

The smaller piston-cylinder units 27 for the round 14*a* are arranged symmetrically with respect to the axis 25*a* of the bending cylinder 25 in polygonal corners 28 (FIG. 7).

In this regard, the central longitudinal axis 29 of the round 14*a* is arranged eccentrically with respect to the work roll axis 30.

Figure 8A:
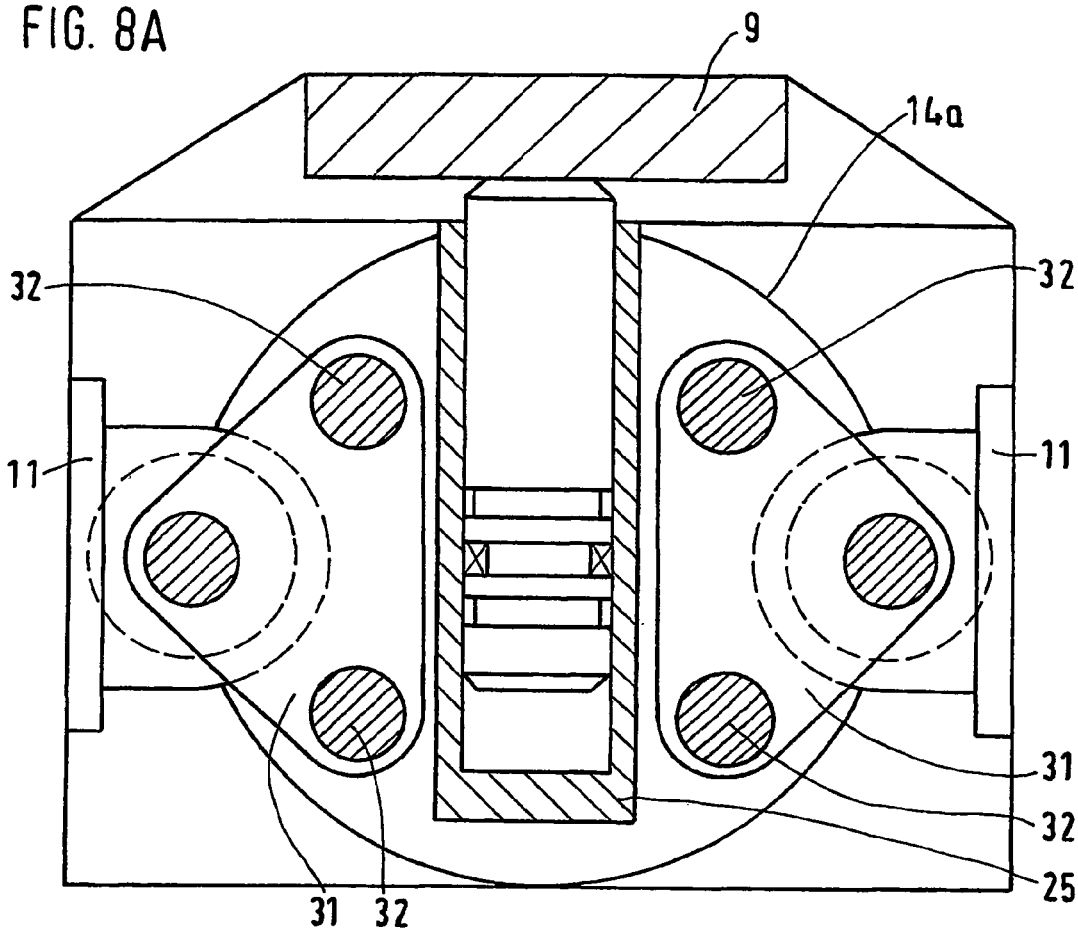
FIG. 8A shows a side view of an embodiment with two piston-cylinder units and four guide rods that engage the round.
Figure 8B:
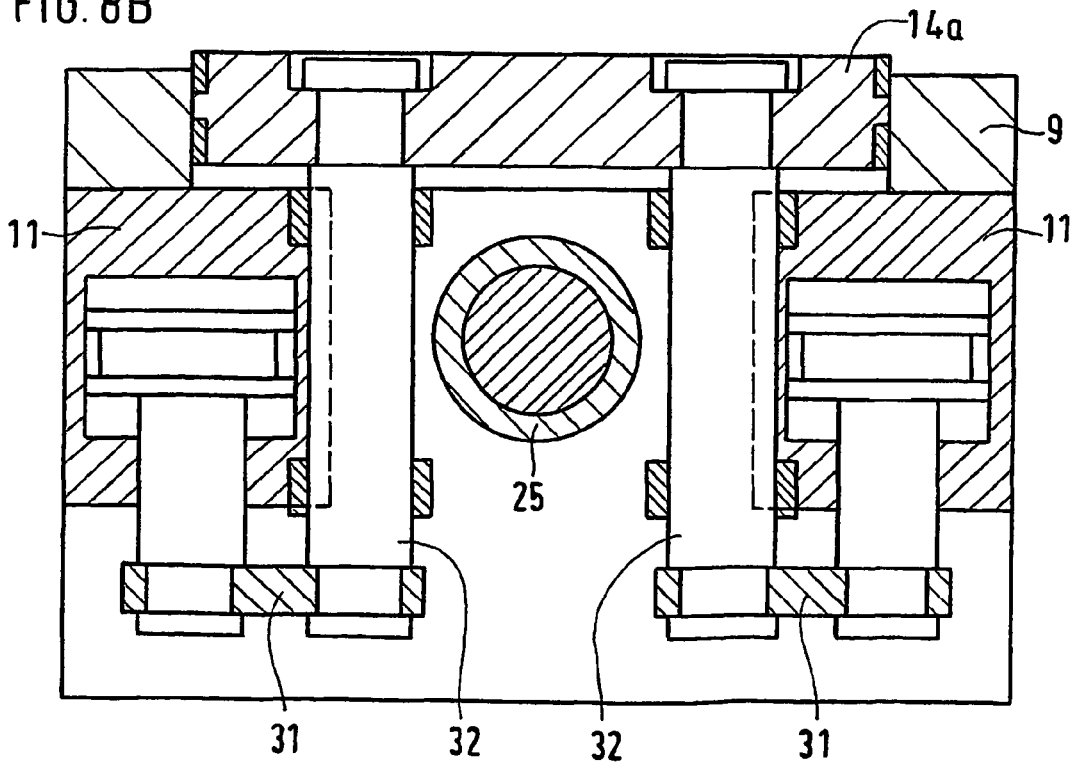
FIG. 8B shows a cross section through the arrangement in FIG. 8A.

FIGS. 8A and 8B show another variation of the design, with which, at some distance from the bending cylinder 25, two symmetrically arranged horizontal piston-cylinder units 11 are supported, each with paired guide rods 32, which are arranged axially and parallel on the piston 18 by straps 31 and jointly hold the round 14*a*.

LIST OF REFERENCE NUMBERS

1 strip material
2 backup roll
3 backup roll
4 work roll
4*a* roll neck
5 work roll
5*a* roll neck
6 chock
7 chock
8 guiding device
9 column frame
9*a* side of column
9*b* side of column
10 roll gap
11 horizontal piston-cylinder unit
11*a* front end of piston
11*b* piston head
12 hydraulic, vertical operating cylinder (vertical roll positioning drive)
13 load cell
14 support element
14*a* round
14*b* periphery of the round
15 guide strips
16 piston rod
17 screw connection
18 piston
19 pressure medium channel
20 pressure medium channel
21 cylinder
22 grooves
23 grooves
24 roll axis
25 bending cylinder
25*a* axis of the bending cylinder
26 distance
27 several smaller piston-cylinder units
28 polygonal corners
29 central longitudinal axis of the round
30 work roll axis
31 strap
32 paired guide rods
33 hexagonal socket screws

The invention claimed is:

1. Rolling stand for the hot rolling or cold rolling of metallic strip material with backup rolls and work rolls, each of which is pivoted in chocks, such that each chock can be displaced on two sides in guiding devices of a column frame for adjusting the roll gap and can be additionally displaced on at least one side for adjusting the play by means of horizontal piston-cylinder units arranged in the column frames, wherein the work roll chocks (6; 7), which are guided on at least one side of a column (9*a*) by means of the piston-cylinder unit (11) arranged in the column frame (9) and by means of one respective support element (14), which is arranged on the front end (11*a*) of the piston, can be pressed against the other side of the column (9*b*) and its guiding device (8) without play, when a vertical roll positioning drive is stopped, and can be released, when the vertical roll positioning drive is turned on, wherein, in connection with a bending cylinder (25) that acts on a roll neck (4*a*; 5*a*) and runs perpendicularly to the roll axis (24), several individual piston-cylinder units (27), which are arranged at some distance (26) from the bending cylinder (25), act on a piston head (11*b*), wherein the hydraulic pressure in the piston-cylinder unit (11) can be regulated to different pressures for play adjustment or play elimination for the chock (6; 7) in the guiding device (8) of the given side of the column (9*a*; 9*b*), and that, for a vertical displacement of the chocks (6; 7), a control can be switched to signals of an automatic gage control (AGC).

2. Rolling stand in accordance with claim 1, wherein each support element (14) consists of a metal round (14*a*) with plastic guide strips (15) embedded in it along its periphery (14*b*), and that the round (14*a*) is supported in the column frame (9).

3. Rolling stand in accordance with claim 2, wherein the round (14*a*) is fastened to a piston rod (16) of the piston-cylinder unit (11).

4. Rolling stand in accordance with claim 2, wherein the round (14*a*) is made of red brass, and that the guide strips (15) embedded in the periphery (14*b*) of the round are made of polytetrafluoroethylene(PTFE).

5. Rolling stand in accordance with claim 2, wherein the piston-cylinder units (27) for the round (14*a*) are arranged symmetrically to an axis (25*a*) of the bending cylinder (25) in polygonal corners (28).

6. Rolling stand in accordance with claim 2, wherein a central longitudinal axis (29) of the round (14*a*) is arranged eccentrically with respect to the axis (30) of the work roll.

7. Rolling stand in accordance with claim 2, wherein two or more rounds, each with a smaller circular area, are provided on the circular area of the round (14*a*).

8. Rolling stand in accordance with claim 1, wherein the piston (18) of the piston-cylinder unit (11) can be acted upon by pressure on both sides.

9. Rolling stand in accordance with claim 1, wherein the piston-cylinder unit (11) can be supplied with pressure medium through channels (19; 20) in the column frame (9).

10. Rolling stand in accordance with claim 9, wherein the channels (19; 20) for the pressure medium open into grooves (22; 23) that run around the cylinder (21) of the piston-cylinder unit (11).

11. Rolling stand in accordance with claim 1, wherein the support element (14) consists of a sliding shoe, which is shaped similarly to a sled runner with suitable runner width and engages with the guiding device (8) of the chocks (6; 7).

* * * * *